US006914505B2

(12) United States Patent
Taniwa

(10) Patent No.: US 6,914,505 B2
(45) Date of Patent: Jul. 5, 2005

(54) DEFLECTION YOKE AND CRT DEVICE

(75) Inventor: Kenichiro Taniwa, Takatsuki (JP)

(73) Assignee: Matsushita Electric Industrial Co., Ltd., Osaka-fu (JP)

( * ) Notice: Subject to any disclaimer, the term of this patent is extended or adjusted under 35 U.S.C. 154(b) by 81 days.

(21) Appl. No.: 10/448,866

(22) Filed: May 30, 2003

(65) Prior Publication Data

US 2004/0032227 A1 Feb. 19, 2004

(30) Foreign Application Priority Data

Jun. 7, 2002 (JP) ..... 2002-167268

(51) Int. Cl.[7] ..... H01F 7/00
(52) U.S. Cl. ..... 335/210; 313/440
(58) Field of Search ..... 335/210–212; 313/440

(56) References Cited

U.S. PATENT DOCUMENTS 4,243,965 A * 1/1981 Yoshikawa ..... 335/213
4,712,080 A * 12/1987 Katou ..... 335/213
5,449,969 A * 9/1995 Washburn ..... 313/440
6,255,770 B1 * 7/2001 Murata ..... 313/440
6,281,623 B1 * 8/2001 Suzuki et al. ..... 313/440
2004/0032197 A1 * 2/2004 Tagami et al. ..... 313/440

FOREIGN PATENT DOCUMENTS

JP 61-56757 9/1984

* cited by examiner

*Primary Examiner*—Elvin G. Enad
*Assistant Examiner*—Bernard Rojas

(57) ABSTRACT

The invention provides a deflection yoke comprising: a tube-shaped core made of a magnetic material that has on its inner wall, ridges each of which extends along the CRT axis direction, the ridges being arranged circumferentially at intervals and thereby forming slots; a vertical deflection coil wound so that part of its length is disposed in the slots; and a horizontal deflection coil wound so that part of its length is disposed in the slots, wherein the slots include (a) first slots in which one of the horizontal deflection coil and the vertical deflection coil is disposed and (b) second slots in which both of the deflection coils are disposed, and the bottom of each first slot is, for part or all of the length of the slot, closer to the external surface of the evacuated envelope than the bottom of each second slot is.

5 Claims, 10 Drawing Sheets

DEFLECTION YOKE AND CRT DEVICE

This application is based on the application No. 2002-167268 filed in Japan, the contents of which are hereby incorporated by reference.

BACKGROUND OF THE INVENTION

1. Field of the Invention

The present invention relates to CRT (Cathode Ray Tube) devices used for TVs and computer displays, and deflection yokes used in such CRT devices, particularly to the structures of the deflection yokes.

2. Description of the Related Art

FIG. 1 is a cross section of a ferrite core, generally called a slot core, being sectioned at a plane perpendicular to the Z axis (the tube axis). The ferrite core 100 in the deflection yoke has, on the inner wall thereof, a plurality of ridges 102 each of which protrudes substantially toward the Z axis (positioned at the center 0) and extends along the Z axis direction, the plurality of ridges 102 being arranged circumferentially. A vertical deflection coil 106 and a horizontal deflection coil 108 are wound so as to be in each slot 104 formed between the ridges 102 positioned adjacent to each other, with an insulating spacer 110 interposed between the deflection coils. The cross sections of the deflection coils are simply indicated with hatching. This technique is disclosed in the Japanese Unexamined Utility Model Application Publication No. 61-56757. The envelope formed by the bottoms of the slots 104 is circular. The envelope formed by the tips of the ridges 102 is also circular. These envelopes are concentric circles having the Z axis as the center.

A deflection yoke with such arrangements has the following advantageous effects over a deflection yoke including a ferrite core that has a smooth inner wall without ridges and slots: The deflection sensitivity is improved because it is possible to position the ferrite core closer to the cathode ray tube, through which the electron beams pass. Also, it is possible to reduce eddy-current loss and inhibit heat generation of the deflection yoke because the magnetic flux is less likely to have a flux linkage with the deflection coils. Consequently, it is possible to save electric energy at the deflection yoke.

In recent years, energy-saving techniques have been an issue in various fields in view of the problems of environmental destruction. The field of CRT (Cathode Ray Tube) devices is not an exception. There are demands for further reduction in electric power consumption even with slot-core type deflection yokes that are already characterized with their lower electric power consumption.

SUMMARY OF THE INVENTION

A first object of the present invention is to provide a deflection yoke that includes a slot core,and is more effective in energy-saving.

A second object of the present invention is to provide a CRT device comprising such a deflection yoke.

It is possible to achieve the first object of the present invention with a deflection yoke provided on an external surface of an evacuated envelope of a cathode ray tube, comprising: a tube-shaped core that is made of a magnetic material, and has, on an inner wall thereof, a plurality of ridges each of which extends along a tube axis direction of the cathode ray tube, the plurality of ridges being arranged circumferentially at predetermined intervals and there by forming a plurality of slots; a vertical deflection coil that is wound so that part of its length is disposed in one or more of the slots of the core; and a horizontal deflection coil that is wound so that part of its length is disposed in one or more of the slots of the core, wherein the slots include (a) first slots in which one of the horizontal deflection coil and the vertical deflection coil is disposed and (b) second slots in which both of the horizontal deflection coil and the vertical deflection coil are disposed, and a bottom of each first slot is, for part or all of a length of the slot, closer to the external surface of the evacuated envelope than a bottom of each second slot is.

It is possible to achieve the second object of the present invention with a cathode ray tube device including a cathode ray tube and a deflection yoke provided on an external surface of an evacuated envelope of the cathode ray tube, the deflection yoke comprising: a tube-shaped core that is made of a magnetic material, and has, on an inner wall thereof, a plurality of ridges each of which extends along a tube axis direction of the cathode ray tube, the plurality of ridges being arranged circumferentially at predetermined intervals and thereby forming a plurality of slots; a vertical deflection coil that is wound so that part of its length is disposed in one or more of the slots of the core; and a horizontal deflection coil that is wound so that part of its length is disposed in one or more of the slots of the core, wherein the slots include (a) first slots in which one of the horizontal deflection coil and the vertical deflection coil is disposed; and (b) second slots in which both of the horizontal deflection coil and the vertical deflection coil are disposed, and a bottom of each first slot is closer to an external surface of the cathode ray tube than a bottom of each second slot is.

BRIEF DESCRIPTION OF THE DRAWINGS

These and other objects, advantages and features of the invention will become apparent from the following description there of taken in conjunction with the accompanying drawings which illustrate a specific embodiment of the invention.

In the drawings.

DESCRIPTION OF THE PREFERRED EMBODIMENTS

The following describes embodiments of the present invention with reference to the drawings.

Figure 2:
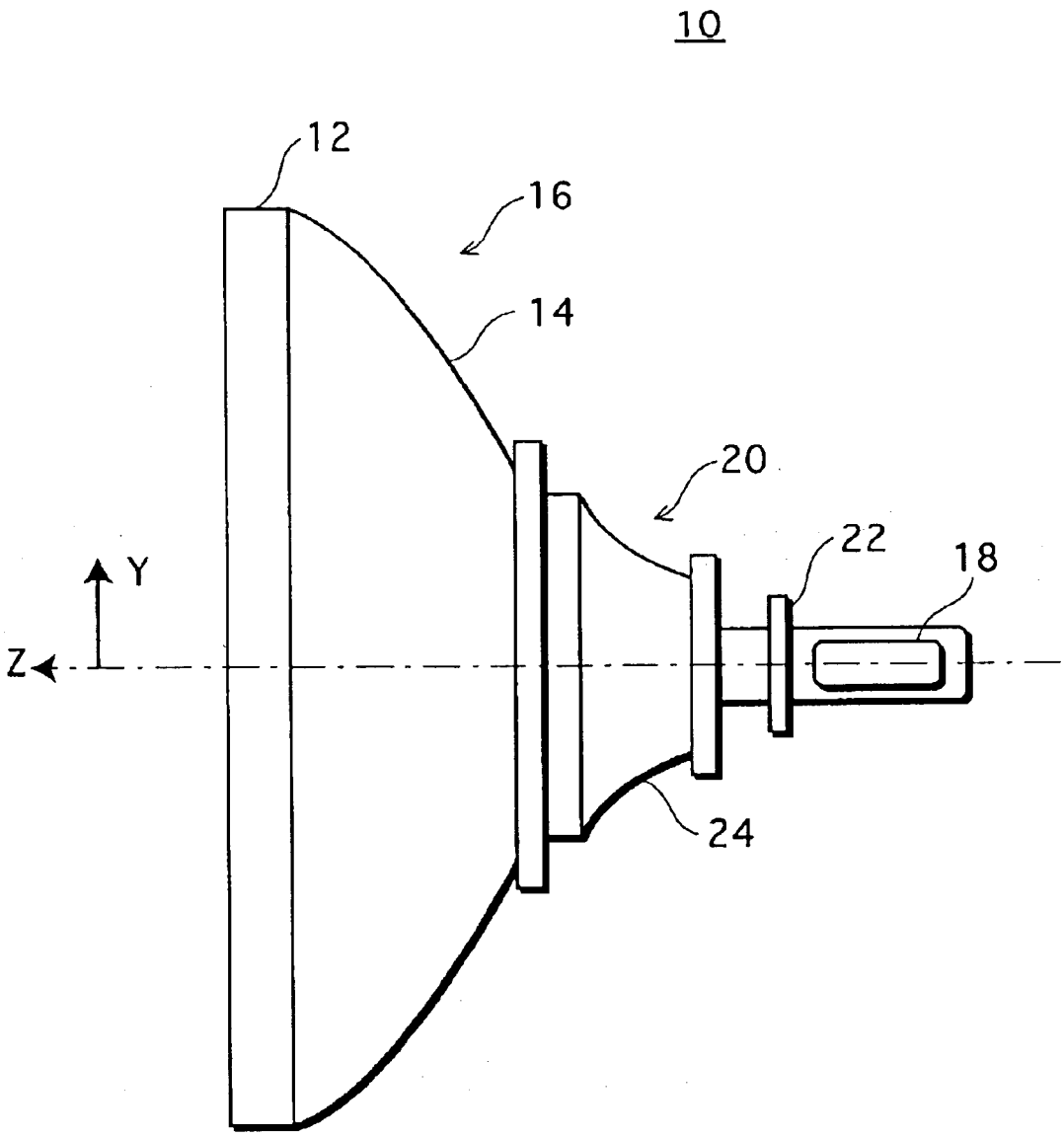
FIG. 2 is a side view to illustrate the general structure of the CRT device.

FIG. 2 is a schematic side view of a color CRT device 10 of an embodiment. The color CRT device 10 comprises: an evacuated envelope 16 in which (a) a front flat panel 12 whose inner surface has a phosphor screen formed thereon and (b) a funnel 14 are joined together; an electron gun 18 disposed in the neck of the funnel 14; a deflection yoke 20 disposed on the external surface of the funnel 14; and a convergence yoke 22. The funnel 14 is literally in the shape of a funnel. The external shape of the funnel 14 in a cross section is substantially in the shape of a pyramid that makes a smooth transition from the neck with a circular cross section to the front flat panel 12 with a substantially rectangular cross section. FIG. 2 merely shows the positional relationship among the aforementioned members, and the members such as the deflection yoke 20 are illustrated in very simplified forms.

Figure 3:
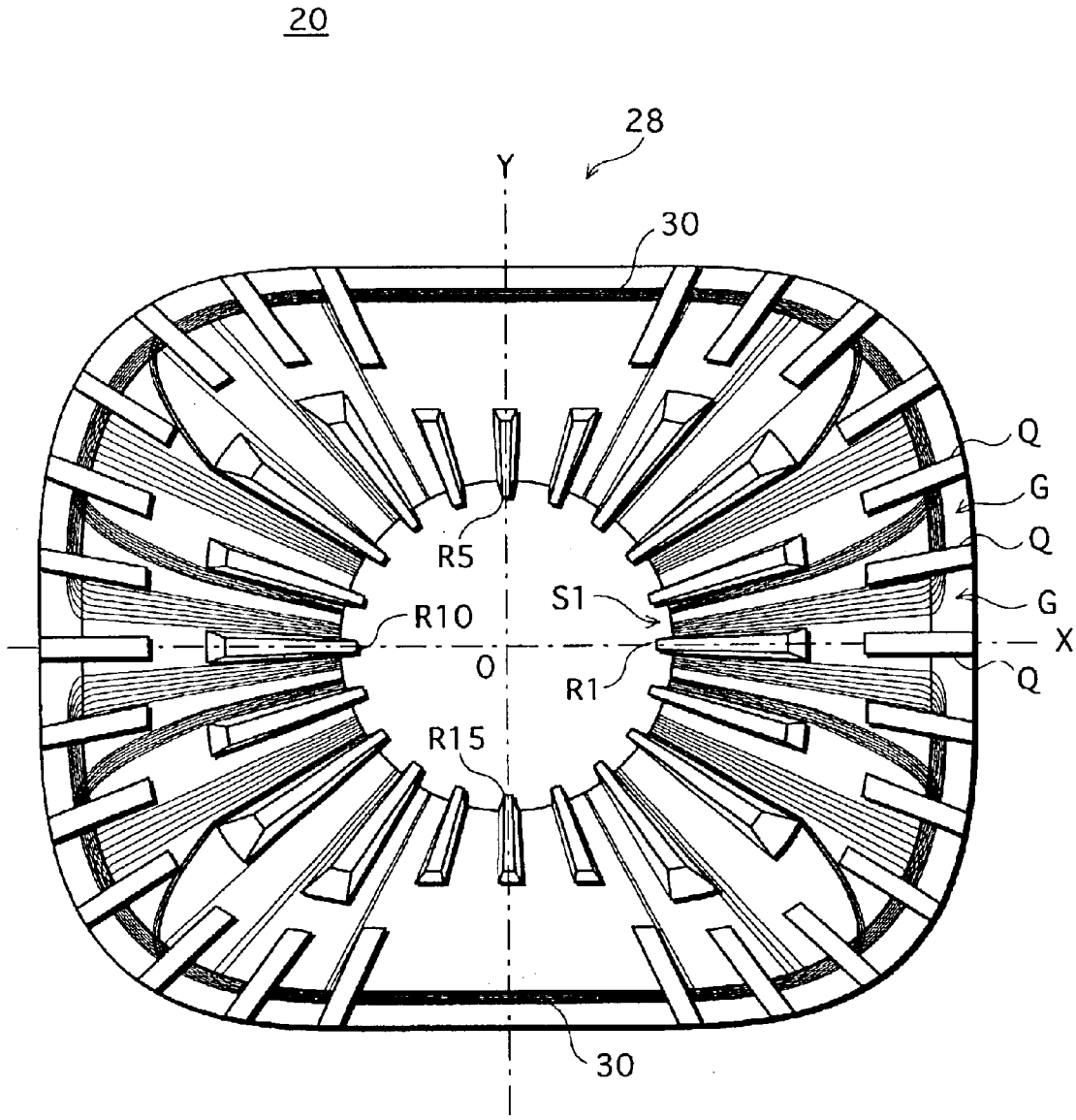
FIG. 3 is a front view to illustrate the general structure of the deflection yoke.
Figure 4:
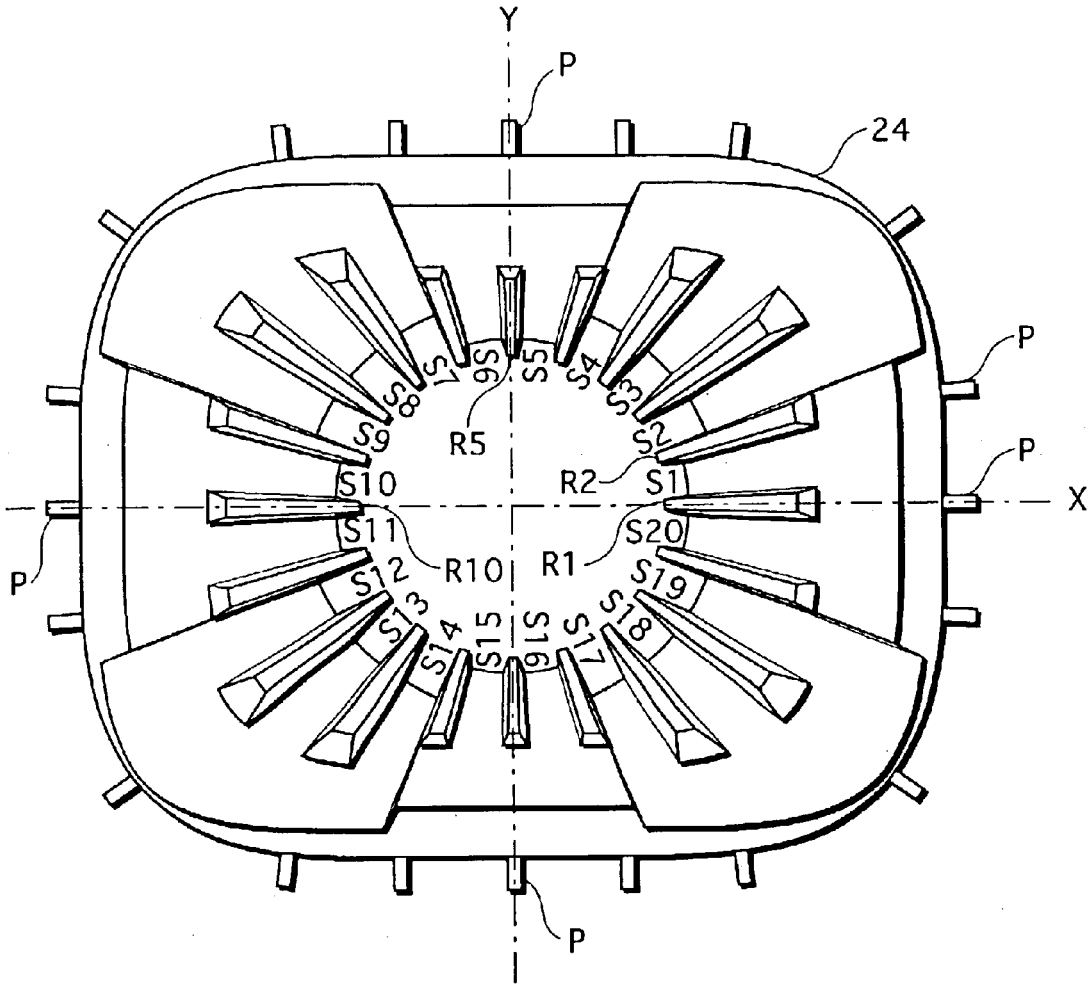
FIG. 4 is a front view of the ferrite core.
Figure 5:
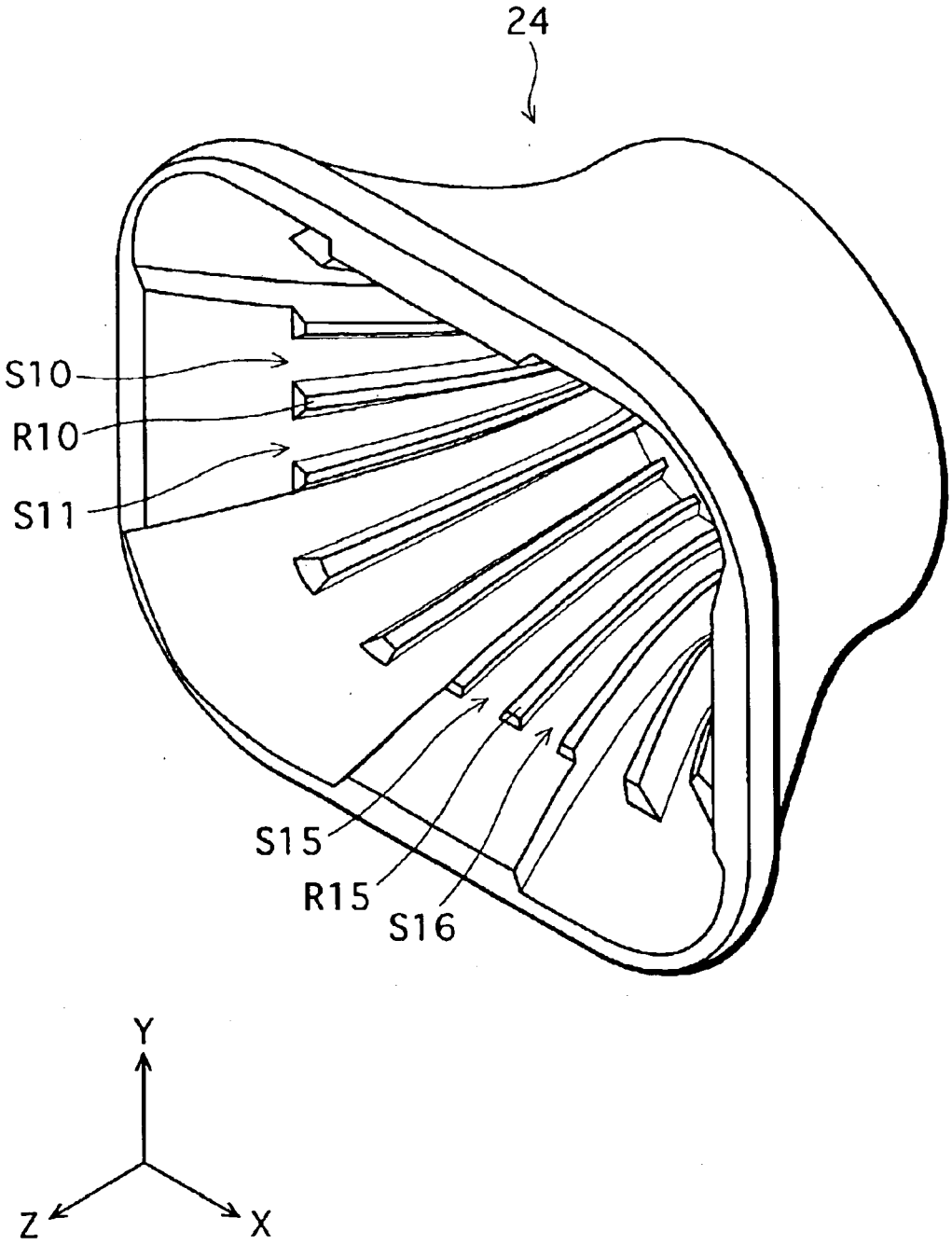
FIG. 5 is a perspective view of the ferrite core.

FIG. 3 is a front view of the deflection yoke 20 being viewed from the phosphor screen side. FIG. 4 is a front view of the core 24. FIG. 5 is a perspective view of the core 24.

In the present application, X denotes a horizontal axis, and Y denotes a vertical axis. Further, an axis that perpendicularly intersects both the X axis and the Y axis at the origin (the zero point) at which the X axis intersects the Y axis will be referred to as the Z axis (the tube axis).

The deflection yoke 20 is made of a magnetic material, and as shown in FIGS. 4 and 5, has a cross section shaped to fit the external shape of the funnel 14. In other words, one end of the deflection yoke 20 has a substantially circular cross section that fits the neck of the funnel, and the other end of the deflection yoke 20 has a substantially rectangular cross section. The shape of the cross section makes a smooth transition from the one end to the other. Ferrite is used as a magnetic material in the present embodiment. Hereafter, the core 24 will be referred to as a ferrite core 24.

The deflection yoke 20 includes a vertical deflection coil 26, an insulating frame 28, and a horizontal deflection coil 30 that are disposed inside the core 24 in the stated order.

As shown in FIG. 4, formed on the inner wall of the ferrite core 24 are a plurality of ridges "Rs" (hereafter referred to as core ridges) each of which extends along the Z axis (the tube axis) direction so as to protrude toward the Z axis, the plurality of core ridges being arranged circumferentially at regular intervals. In the present example, twenty core ridges are formed at 18-degree intervals. As shown in FIGS. 4 and 5, the core ridges Rs are formed partway from the narrower end (the end on the electron gun side) to the larger end (the end on the phosphor screen side). As shown in FIG. 4, viewing the ferrite core 24 from the front (from the phosphor screen side) helps you understand that the core ridges Rs are provided in a radial pattern. As for the core ridges Rs on the X axis, the core ridge that is on the right side as we face FIG. 4 will be referred to as R1, and serial numbers will be given counterclockwise starting from R1, in order to identify each of the core ridges as R1 to R20. The intervals between the core ridges are not limited to the ones mentioned above. It is also acceptable if the intervals are not regular intervals.

As a result of the core ridges Rs being formed, a slot (hereafter referred to as a core slot) "S" is formed between the ridges positioned adjacent to each other. The core slot formed by the core ridge R1 and the core ridge R2 will be referred to as the core slot S1, and serial numbers will be given counterclockwise starting from S1, in order to identify each of the core slots as S1 to S20.

A vertical deflection coil 26 and a horizontal deflection coil 30 are wound on the ferrite core 24, so as to be partially guided by the core slots Ss.

Among the core slots S1 to S20, as will be explained later, only the vertical deflection coil 26 is wound into the core slots S5, S6, S15, and S16 that are in the vicinity of the Y axis. Only the horizontal deflection coil 30 is wound into the core slots S1, S10, S11, and S20 that are in the vicinity of the X axis. Both of the deflection coils 26 and 30 are wound into the other core slots such as S2 to S4, S7 to S9, S12 to S14, and S17 to S19. In other words, in the core slots S5, S6, S15, S16, S1, S10, S11, and S20 (hereafter, referred to as exclusive core slots), only one of the two kinds of deflection coils is exclusively disposed. The core slots S2 to S4, S7 to S9, S12 to S14, and S17 to S19 (hereafter, referred to as shared core slots) are shared by both of the deflection coils 26 and 30.

Also, as shown in FIG. 4, the exclusive core slots are shallower than the shared core slots. In other words, the bottom of each of the exclusive core slots is closer to the external surface of the funnel 14 (or the cathode ray tube) than the bottom of each of the shared core slots is. The reason for this arrangement will be explained later.

Further, projections "Ps" are provided on the external surface of the ferrite core 24 at the vicinity of the wider end at such positions to which the lines extended from the core ridges R1 to R20 correspond respectively. The projections Ps are pins made of synthetic resin that are adhered to the external surface of the ferrite core 24. In FIG. 5, the projections Ps are omitted from the drawing.

A vertical deflection coil 26 is wound into the shape of a saddle directly on the ferrite core 24 that has the aforementioned arrangements.

Figure 6:
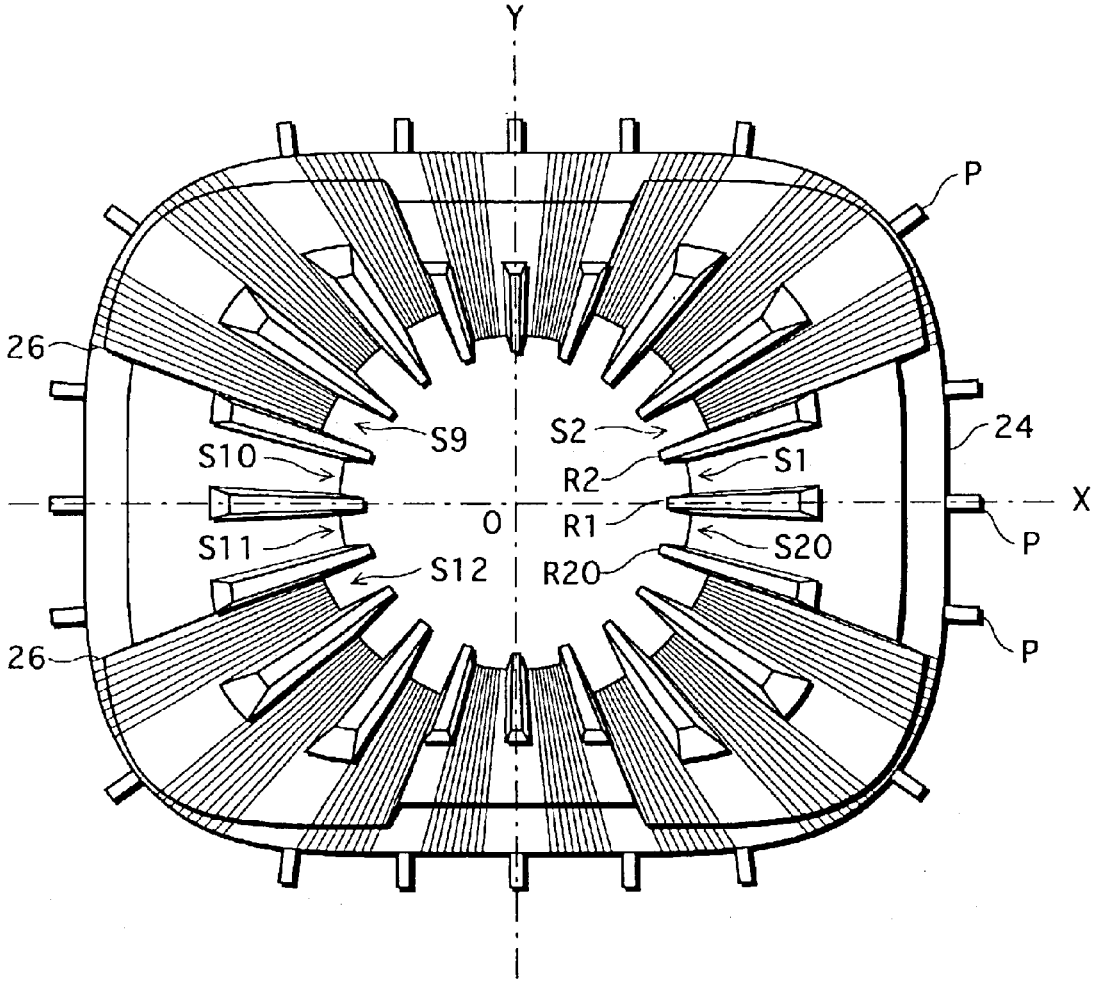
FIG. 6 is a front view of the ferrite core on which a vertical deflection coil is wound.

FIG. 6 shows how it is wound.

The vertical deflection coil 26 is wound so as to be disposed in the core slots S2 to S9, and S12 to S19, and not in the core slots S1, S10, S11, and S20. Thus, in the area closer to the electron gun that has the core slots provided, the vertical deflection coil 26 is wound with a winding angle defined by the core slots S2 to S9, and S12 to S19.

On the external surface of the ferrite core 24 at the vicinity of the wider end, the vertical deflection coil 26 is wound so as to hook around the projections Ps. In other words, as the vertical deflection coil 26 is wound with a winding angle defined by the projection Ps, it is possible to achieve the winding distribution as desired. The positions of the projections Ps are not limited to the ones mentioned above, and it is also acceptable to dispose the projections Ps at arbitrary positions, being irrelevant to the positions of the core ridges. According to this arrangement, it is possible to achieve, in an area closer to the phosphor screen that has no core slots provided, winding distribution that is not restricted so much by the positions of the core slots.

Figure 7:
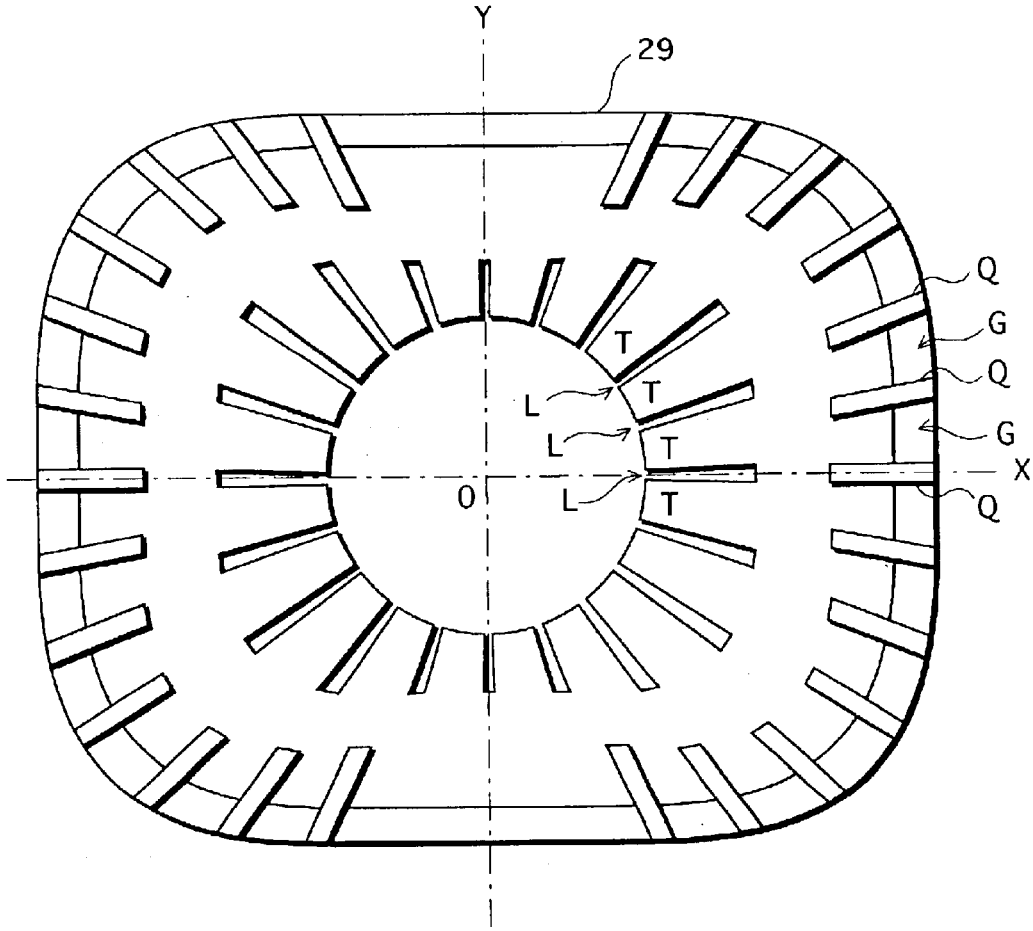
FIG. 7 is a front view of the insulating frame.
Figure 8:
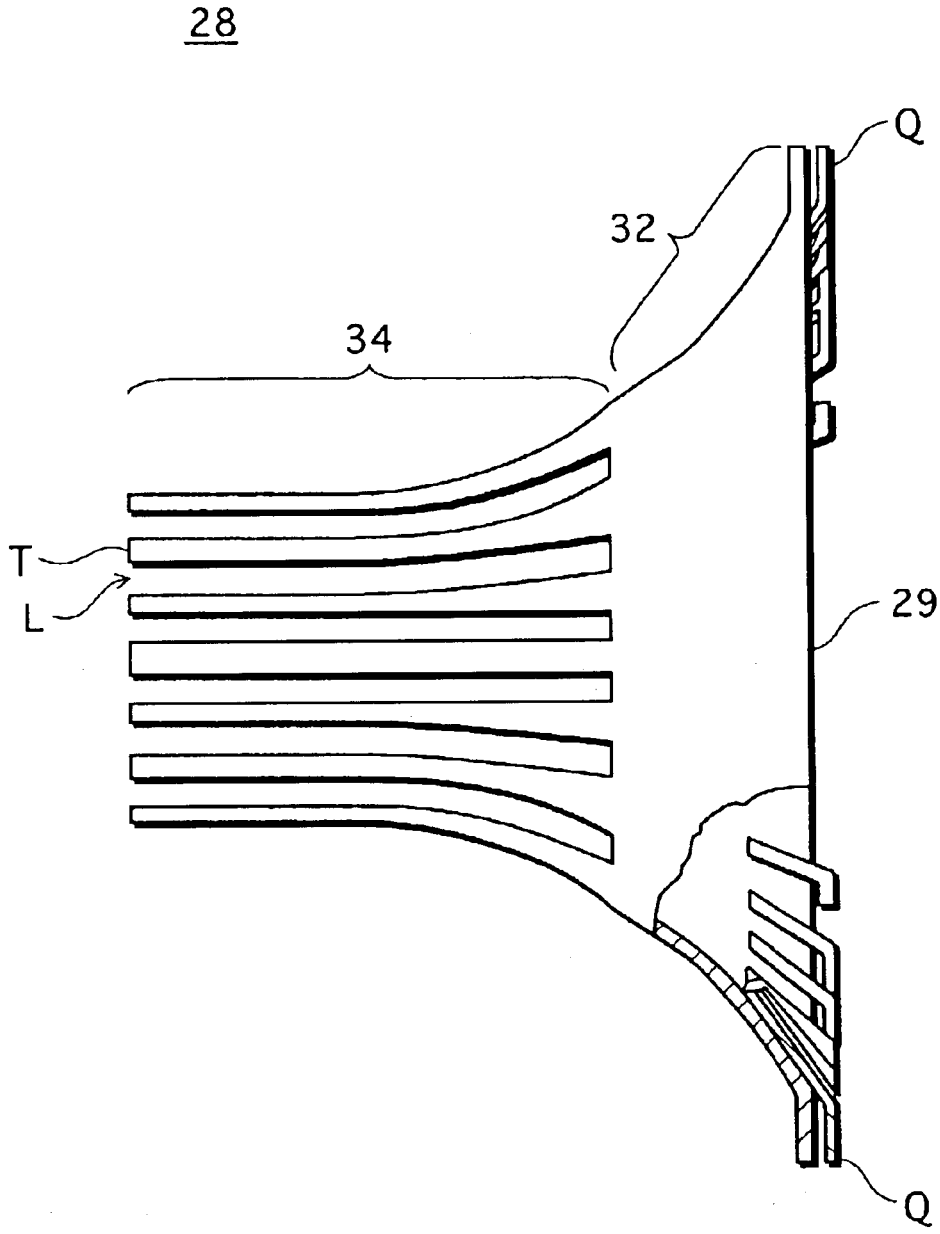
FIG. 8 is a plan view of the insulating frame.

FIG. 7 is a front view of the insulating frame 28. FIG. 8 is partially cut-out plan view of the insulating frame 28.

The insulating frame 28 includes a main body 29 that is substantially in the shape of a truncated cone so as to fit the external shape of the funnel 14, and is made of synthetic resin. The main body 29 electrically insulates the vertical deflection coil 26 from the horizontal deflection coil 30.

The main body 29 is made up of an insulating frame cone 32 that widens toward the phosphor screen side and an insulating frame neck 34 that extends toward the electron gun side.

Formed on the inner wall of the insulating frame cone 32 are a plurality of projections "Qs" (hereafter referred to as guiding projections) each of which extends along the Z axis (the tube axis) direction so as to protrude toward the Z axis, the plurality of guiding projections being arranged circumferentially at predetermined intervals. The guiding projections Qs are curved bars made of synthetic resin that are adhered to the inner wall of the main body 29. As shown in FIGS. 7 and 8, the guiding projections Qs are provided on the wider end side (the end on the phosphor screen side) of the main body 29. As shown in FIG. 7, viewing the insulating frame 28 from the front (from the phosphor screen side) helps you understand that the guiding projections Qs are provided in a radial pattern. The end of each of the guiding projections on the phosphor screen side is apart from the inner wall of the main body 29 (the insulating frame cone 32) so that there is a space therebetween. As will be explained later, the horizontal deflection coil 30 is wound so as to hook around each of the parts of the guiding projections Qs that form such spaces.

As a result of the guiding projections Qs being formed as mentioned above, a slot (hereafter referred to as a guiding slot) "G" is formed between the guiding projections Qs adjacent to each other.

Provided in the insulating frame neck 34 are a plurality of slits "Ls" each of which extends along the Z axis (the tube axis) direction, and has a predetermined width and a predetermined length. The width will be determined according to the width of the core ridges Rs in the ferrite core 24. The length will be determined according to the length of the core ridges Rs in the ferrite core 24.

As a result of such slits being provided, the insulating frame cone 32 has a plurality of belt-shaped members "Ts" protruding. As shown in FIG. 8, with such belt-shaped members Ts protruding, the insulating frame neck 34 looks like it has teeth of a comb.

The insulating frame 28 with the aforementioned arrangements will be attached to the ferrite core 24 (FIG. 6) on which the vertical deflection coil 26 is wound. The procedure of attaching the insulating frame 28 to the ferrite core 24 is done by inserting the insulating frame 28, with its end on the insulating frame neck 34 side first, into the wider end of the ferrite core 24. At this time, the insulating frame 28 and the ferrite core 24 will be attached to each other by relatively being slid in the Z axis (the tube axis) direction, so that the slits Ls are fitted into the corresponding core ridges R1 to R20 respectively, in other words, so that the belt-shaped members Ts go into the corresponding core slots S1 to S20, respectively.

After this attaching procedure is finished, the horizontal deflection coil 30 will be wound into the shape of a saddle on the insulating frame 28 as shown in FIG. 3.

It is acceptable to provide the guiding projections Qs only in the area where the horizontal deflection coil 30 is wound. It is not necessary to provide the guiding projections Qs in the area where the coil is not wound. FIGS. 3 and 7 illustrate an example in which the projections Qs are not provided in the vicinity of the Y axis. It is also acceptable to provide guiding slots in the main body 29 of the insulating frame 28, instead of providing guiding projections Qs.

Figure 9:
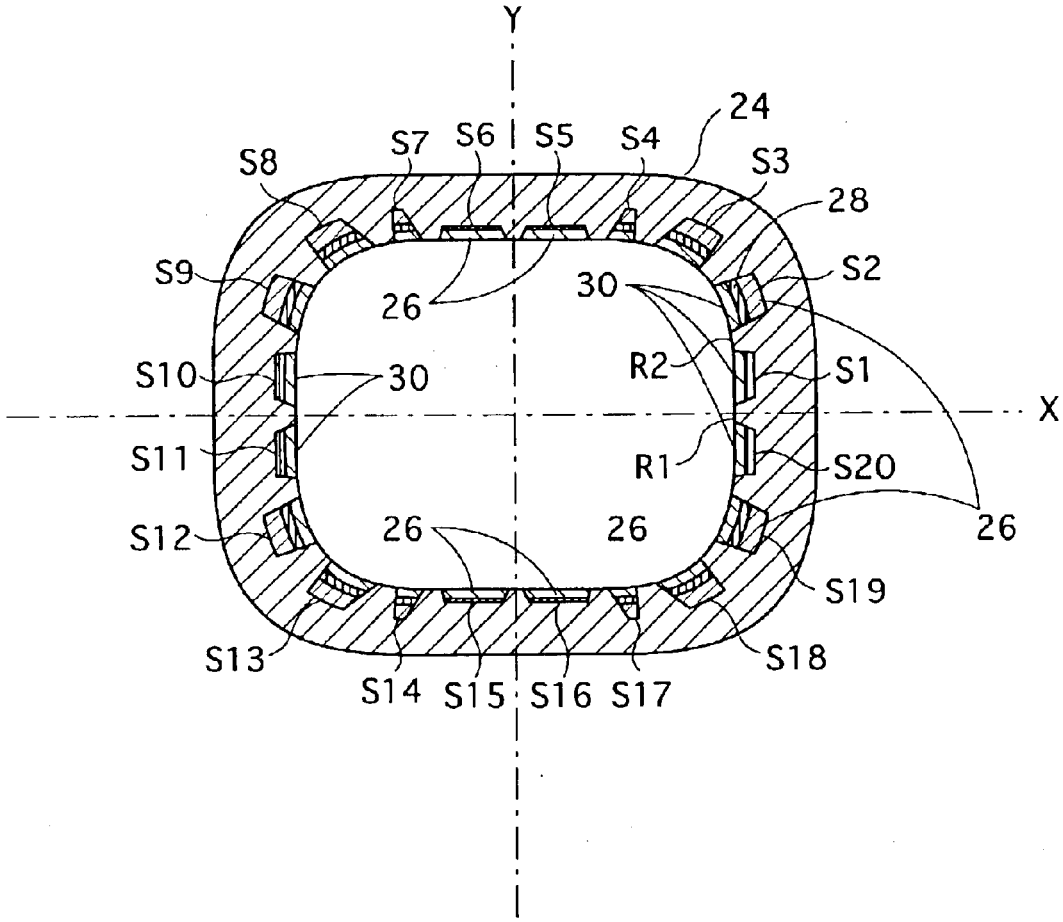
FIG. 9 is a cross section of the deflection yoke, being sectioned at a plane perpendicular to the tube axis.

FIG. 9 shows a cross section of the deflection yoke 20, after the horizontal deflection coil 30 is wound thereon, the deflection yoke being sectioned at a plane perpendicular to the Z axis (the tube axis). The sectioning point of the cross section is positioned, in terms of the Z axis direction, at where the ferrite core 24 has the core slots, on the phosphor screen side thereof. In FIG. 9, the sectional view of each of the deflection coils is simply indicated with hatching. As shown in FIG. 9, the vertical deflection coil 26 and the horizontal deflection coil 30 are wound so as to be guided by the core slots S1 to S20. These two kinds of coils are securely insulated from each other by the belt-shaped members Ts.

As mentioned earlier, the exclusive core slots such as S5, S6, S15, S16, S1, S10, S11, and S20 are shallower than the shared core slots such as S2 to S4, S7 to S9, S12 to S14, and S17 to S19. In other words, the bottom of each of the exclusive core slots S5, S6, S15, S16, S1, S10, S11, and S20 is closer to the external surface of the funnel 14 (or the cathode ray tube) than the bottom of each of the shared core slots S2 to S4, S7 to S9, S12 to S14, and S17 to S19 is.

Figure 1:
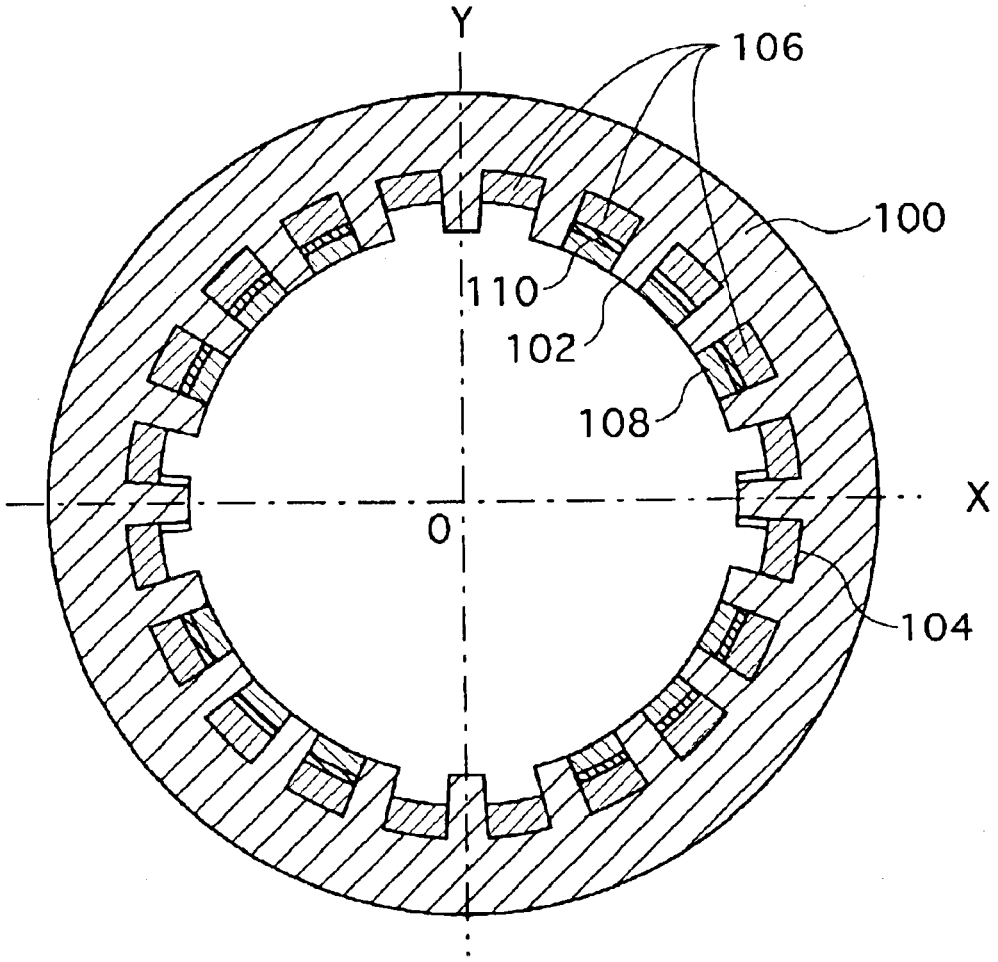
FIG.1 PRIOR ART
FIG. 1 is a cross section of a deflection yoke of the prior art, being sectioned at a plane perpendicular to the tube axis.

In a yoke deflection of the prior art, as shown in FIG. 1, all the core slots have the same depth, regardless of whether each core slot is an exclusive core slot or a shared core slot. Also, the deflection coils are wound so as to be drawn to the bottom of each of the core slots. Consequently, in the exclusive core slots where the amount of wound coil is smaller, there will be a wasteful space formed between the deflection coil in the core slot and the external surface of the cathode ray tube (or the evacuated envelope).

Accordingly, in the present embodiment, it is arranged so that the deflection coil even in an exclusive core slot can be as close as possible to the cathode ray tube (or the evacuated envelope), by making the exclusive core slots shallower than the shared core slots and getting rid of the wasteful spaces. Thus, it is possible to further improve the deflection sensitivity and reduce electric power consumption.

As additional information, the bottom of each of the exclusive core slots does not necessarily have to be closer to the external surface of the evacuated envelope than the bottom of each of the shared core slots is, for the whole length of it. It is possible to achieve the effects of reducing the electric power consumption if there is at least one spot in the tube axis direction, i.e. partially, where the bottom of an exclusive core spot is closer to the external surface of the evacuated envelope than the bottom of a shared core slot is.

Further, in the present embodiment, the insulating frame 28 has belt-shaped members Ts that correspond to all the core spots; however, there is no need to provide insulation between the deflection coils in the exclusive core slots, it is therefore possible not to have belt-shaped members in the exclusive core slots. When it is arranged so that there are no belt-shaped members in the exclusive core slots, the exclusive core slots can be made even shallower for the thickness of the belt-shaped members. This way, it is possible to further improve the deflection sensitivity and save electric power.

Additionally, in the present embodiment, the ferrite core is shaped to fit the external shape of the evacuated envelope. In other words, the deflection yoke is attached so as to cover the area of the evacuated envelope where its external shape in a cross section being sectioned at a plane perpendicular to the tube axis of the cathode ray tube makes a smooth transition from circular to substantially rectangular, and therefore, the tube-shaped ferrite core 24 is shaped so that, for its whole length in the tube axis direction, the cross section thereof being sectioned at the same plane substantially fits the external shape of the evacuated envelope; however, the shape of the ferrite core is not limited to this, and it is also possible to arrange it so that the shape of the cross section at the plane is substantially circular for the whole length in the tube axis direction.

Figure 10:
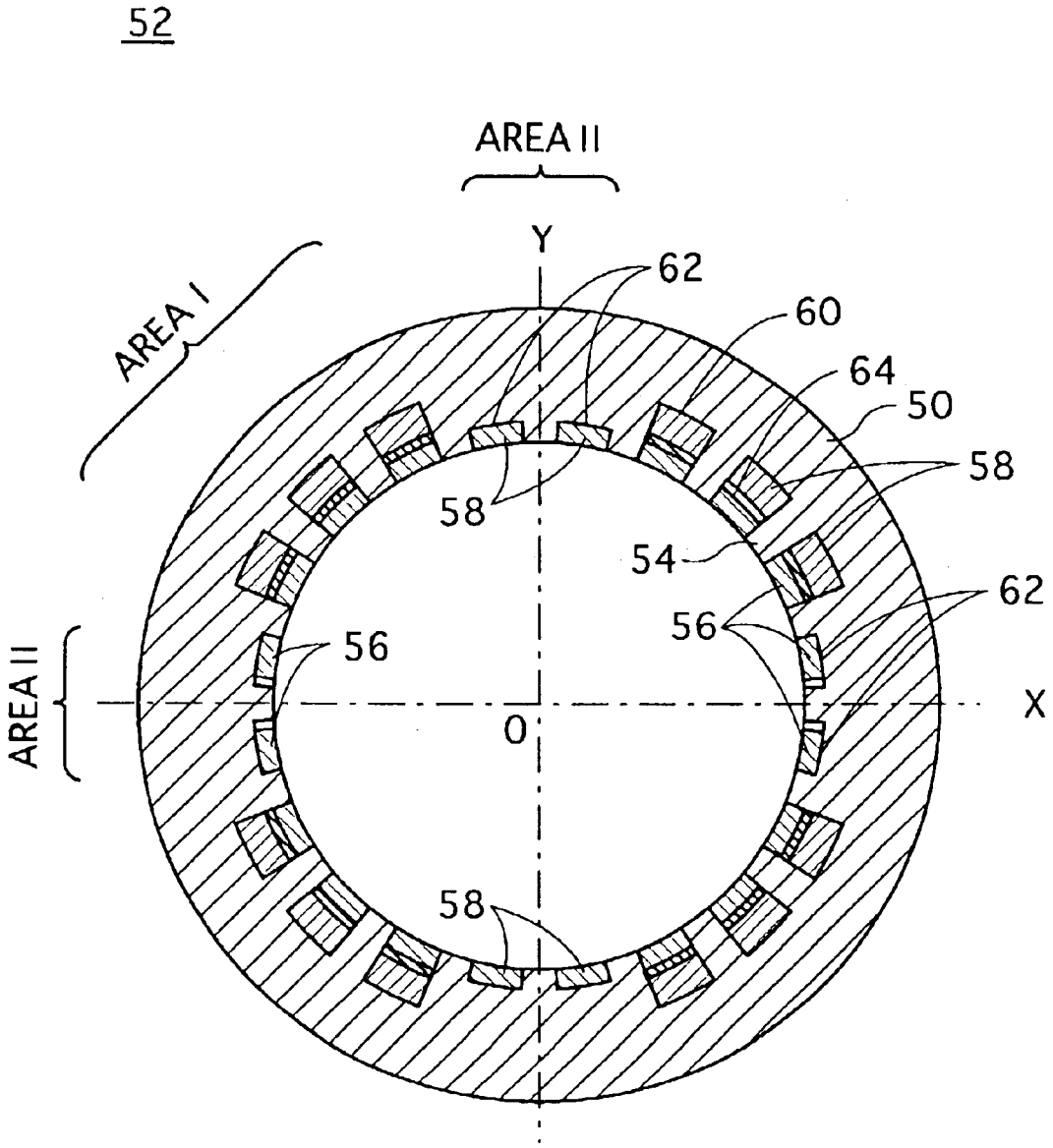
FIG. 10 is a cross section of the deflection yoke of a modification example, being sectioned at a plane perpendicular to the tube axis.

FIG. 10 is across section of a deflection yoke 52 including a ferrite core 50 with such an arrangement, being sectioned at a plane perpendicular to the tube axis. The sectioning point in terms of the tube axis direction is the same as the case shown in FIG. 9.

The ferrite core 50 is also a slot core. On the inner wall, a plurality of ridges 54 are formed, protruding toward the Z axis (the tube axis) at intervals of predetermined angles. In the present example, twenty ridges are formed at 18-degree intervals. A horizontal deflection coil 56 and a vertical deflection coil 58 are wound with a winding angle defined by the slots 60 and the slots 62 formed between the ridges 54, so as to achieve winding distribution as desired.

In FIG. 10, the core slots in "Area I" are shared core slots, and the ones in "Area II" are exclusive core slots. In the shared core slots, the horizontal deflection coil 56 and the vertical deflection coil 58 are insulated by the belt-shaped members 64 (of the insulating frame). The example shown in FIG. 10 illustrates the aforementioned case where there are no belt-shaped members provided in the exclusive core slots.

The slots 62 in Area II in the vicinity of the X axis and the Y axis are shallower than the slots 60 in Area I, and the bottom of each of the slots 62 is closer to the Z axis (the tube axis). As for the slots 62 in the vicinity of the X axis into which only the horizontal deflection coil 56 is wound, the distance between the bottom and the tip of the ridge 54 i.e. the depth is 2 mm. As for the slots 62 in the vicinity of the Y axis into which only the vertical deflection coil 58 is wound, the depth is 3 mm.

As for each of the slots 60 in Area II into which both of the horizontal deflection coil 56 and the vertical deflection coil 58 are wound, the depth is 5 mm.

As an example of the effects of reducing the deflection power by the present invention, the horizontal deflection power is reduced by approximately 3 to 5%, and the vertical deflection power by approximately 2 to 4%.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A deflection yoke provided on an external surface of an evacuated envelope of a cathode ray tube, comprising:

a tube-shaped core that is made of a magnetic material, and has, on an inner wall thereof, a plurality of ridges each of which extends along a tube axis direction of the cathode ray tube, the plurality of ridges being arranged circumferentially at predetermined intervals and thereby forming a plurality of slots;

a vertical deflection coil that is wound so that part of its length is disposed in one or more of the slots of the core; and a horizontal deflection coil that is wound so that part of its length is disposed in one or more of the slots of the core, wherein the slots include (a) first slots in which one of the horizontal deflection coil and the vertical deflection coil is disposed and (b) second slots in which both of the horizontal deflection coil and the vertical deflection coil are disposed, and a bottom of each first slot is, for part or all of a length of the slot, closer to the external surface of the evacuated envelope than a bottom of each second slot is.

2. The deflection yoke of claim 1, wherein the deflection yoke is provided on the evacuated envelope so as to cover such an area of the evacuated envelope where its external shape in a cross section makes a smooth transition from circular to substantially rectangular, the cross section being sectioned at a plane perpendicular to the tube axis, and the tube-shaped core is shaped so that, for its whole length in the tube axis direction, across section thereof substantially fits the external shape of the evacuated envelope, the cross section being sectioned at the plane.

3. The deflection yoke of claim 1, wherein the tube-shaped core is shaped so that, for its whole length in the tube axis direction, a cross section thereof is substantially circular, the cross section being sectioned at a plane perpendicular to the tube axis.

4. The deflection yoke of claim 3, wherein the bottom of each first slot is closer to the tube axis than the bottom of each second slot is.

5. A cathode ray tube device including a cathode ray tube and a deflection yoke provided on an external surface of an evacuated envelope of the cathode ray tube, the deflection yoke comprising:

a tube-shaped core that is made of a magnetic material, and has, on an inner wall thereof, a plurality of ridges each of which extends along a tube axis direction of the cathode ray tube, the plurality of ridges being arranged circumferentially at predetermined intervals and thereby forming a plurality of slots;

a vertical deflection coil that is wound so that part of its length is disposed in one or more of the slots of the core; and a horizontal deflection coil that is wound so that part of its length is disposed in one or more of the slots of the core, wherein the slots include (a) first slots in which one of the horizontal deflection coil and the vertical deflection coil is disposed; and (b) second slots in which both of the horizontal deflection coil and the vertical deflection coil are disposed, and a bottom of each first slot is closer to an external surface of the cathode ray tube than a bottom of each second slot is.

* * * * *